US007529518B2

(12) United States Patent
Kubo

(10) Patent No.: US 7,529,518 B2
(45) Date of Patent: May 5, 2009

(54) IMAGE FORMING APPARATUS

(75) Inventor: Takashi Kubo, Kyoto (JP)

(73) Assignee: Sharp Kabushiki Kaisha, Osaka-Shi (JP)

( * ) Notice: Subject to any disclaimer, the term of this patent is extended or adjusted under 35 U.S.C. 154(b) by 348 days.

(21) Appl. No.: 11/181,880

(22) Filed: Jul. 15, 2005

(65) Prior Publication Data

US 2006/0018692 A1 Jan. 26, 2006

(30) Foreign Application Priority Data

Jul. 20, 2004 (JP) ..... 2004-211426

(51) Int. Cl.
*G03G 15/00* (2006.01)

(52) U.S. Cl. ..... 399/405; 399/18

(58) Field of Classification Search ..... 399/405, 399/18

See application file for complete search history.

(56) References Cited

U.S. PATENT DOCUMENTS

2004/0108645 A1 * 6/2004 Lindelof et al. ..... 271/3.15

FOREIGN PATENT DOCUMENTS

JP H05-022445 U 3/1993
JP 06191128 A * 7/1994
JP 2001-206609 A 7/2001
JP 2001261227 A * 9/2001
JP 2001341922 A * 12/2001
JP 2005-084439 A 3/2005

* cited by examiner

*Primary Examiner*—Ren Yan
*Assistant Examiner*—Andy L Pham
(74) *Attorney, Agent, or Firm*—Birch, Stewart, Kolasch & Birch, LLP

(57) ABSTRACT

An image forming apparatus includes an original scanning section, a sheet feeding section, an image forming section, a sheet receiving section and an indicator (LEDs). The image forming section is located between the original scanning section and the sheet feeding section and has a smaller cross-sectional area when cut by a horizontal plane than either of the original scanning section and the sheet feeding section such that a sheet receiving space into which each sheet of the printing medium is ejected is left between the original scanning section and the sheet feeding section. The sheet receiving section is located in the sheet receiving space for receiving the sheets of the printing medium ejected from the image forming section. The indicator notifies users that one or more sheets of the printing medium have been delivered to the sheet receiving section by emitting light.

11 Claims, 4 Drawing Sheets

IMAGE FORMING APPARATUS

CROSS REFERENCE

This Nonprovisional application claims priority under 35 U.S.C. § 119(a) on Patent Application No. 2004-211426 filed in Japan on Jul. 20, 2005, the entire contents of which are hereby incorporated by reference.

BACKGROUND OF THE INVENTION

The present invention relates generally to an image forming apparatus for forming an image on a printing medium and, more particularly, the invention pertains to an image forming apparatus which delivers each sheet of a printing medium to a location surrounded by an original scanning section, an image forming section and a sheet feeding section.

Conventionally, most of image forming apparatuses are provided with a sheet receiving section projecting outward from a side surface of a housing. This kind of image forming apparatus requires a relatively large space for installation since not only a space for the housing but also a space for the sheet receiving section are needed.

Japanese Patent Application Laid-open No. 2001-206609 shows an image forming apparatus employing a front access type sheet receiving section which allows a user to remove sheets of a printing medium ejected to the sheet receiving section from a front side of the apparatus. This image forming apparatus includes an original scanning section, an image forming section and a sheet feeding section which are disposed in this order from top to bottom, in which the image forming apparatus is structured such that the image forming section has a small cross-sectional area when cut by a horizontal plane as compared to the original scanning section and the sheet feeding section. In this image forming apparatus, the front access type sheet receiving section is disposed so as to be surrounded by the original scanning section, the image forming section and the sheet feeding section. The sheet receiving section thus configured offers an advantage that the image forming apparatus can be installed in a small space.

The front access type sheet receiving section however has a problem that the sheets ejected to the sheet receiving section are difficult to see from a distance. For this reason, it is occasionally difficult for a user who has entered an image forming command from a place distant from the image forming apparatus to examine whether an image forming job has completed. Consequently, the sheets already delivered to the sheet receiving section would often be left uncollected.

On the other hand, it is difficult to provide a large number of sheet receiving trays in the sheet receiving section because the sheet receiving section is located in a limited space surrounded by the original scanning section, the image forming section and the sheet feeding section. To make efficient use of a small number of sheet receiving trays, it is not desirable that the sheets be left unremoved from the sheet receiving trays. Therefore, it is needed to enable the user to recognize that the printed sheets have been ejected to the sheet receiving section so that the user would collect the sheets as soon as possible upon completion of each image forming job.

Accordingly, it is an object of the invention to provide an image forming apparatus employing a front access type sheet receiving section which allows a user to recognize completion of an image forming job from a distance.

SUMMARY OF THE INVENTION

According to the invention, an image forming apparatus includes an original scanning section, an image forming section and a sheet feeding section which are disposed in this order from top to bottom. The image forming section has a smaller cross-sectional area when cut by a horizontal plane than the original scanning section and the sheet feeding section in order that a sheet receiving section into which each sheet of a printing medium is ejected is formed between the original scanning section and the sheet feeding section. In this construction, the sheet receiving section is disposed in a space surrounded by the original scanning section, the image forming section and the sheet feeding section, so that the sheet receiving section does not project outward from a side surface of a housing of the image forming apparatus.

The image forming apparatus of the invention further includes an indicator for notifying that one or more sheets of the printing medium have been delivered to the sheet receiving section by emitting light. The indicator serves to notify users situated at a distance from the image forming apparatus of completion of an image forming job. Since even those users who are situated away from the image forming apparatus can recognize completion of the image forming job with the aid of the indicator, it becomes easy for each user to collect printouts delivered to the sheet receiving section earlier. The indicator may be disposed at any easy-to-see location, such as a top surface, a side surface or a front surface of the image forming apparatus whichever convenient to the users.

These and other objects, features and advantages of the invention will become more apparent upon reading the following detailed description along with the accompanying drawings.

DETAILED DESCRIPTION OF THE INVENTION

Figure 1:
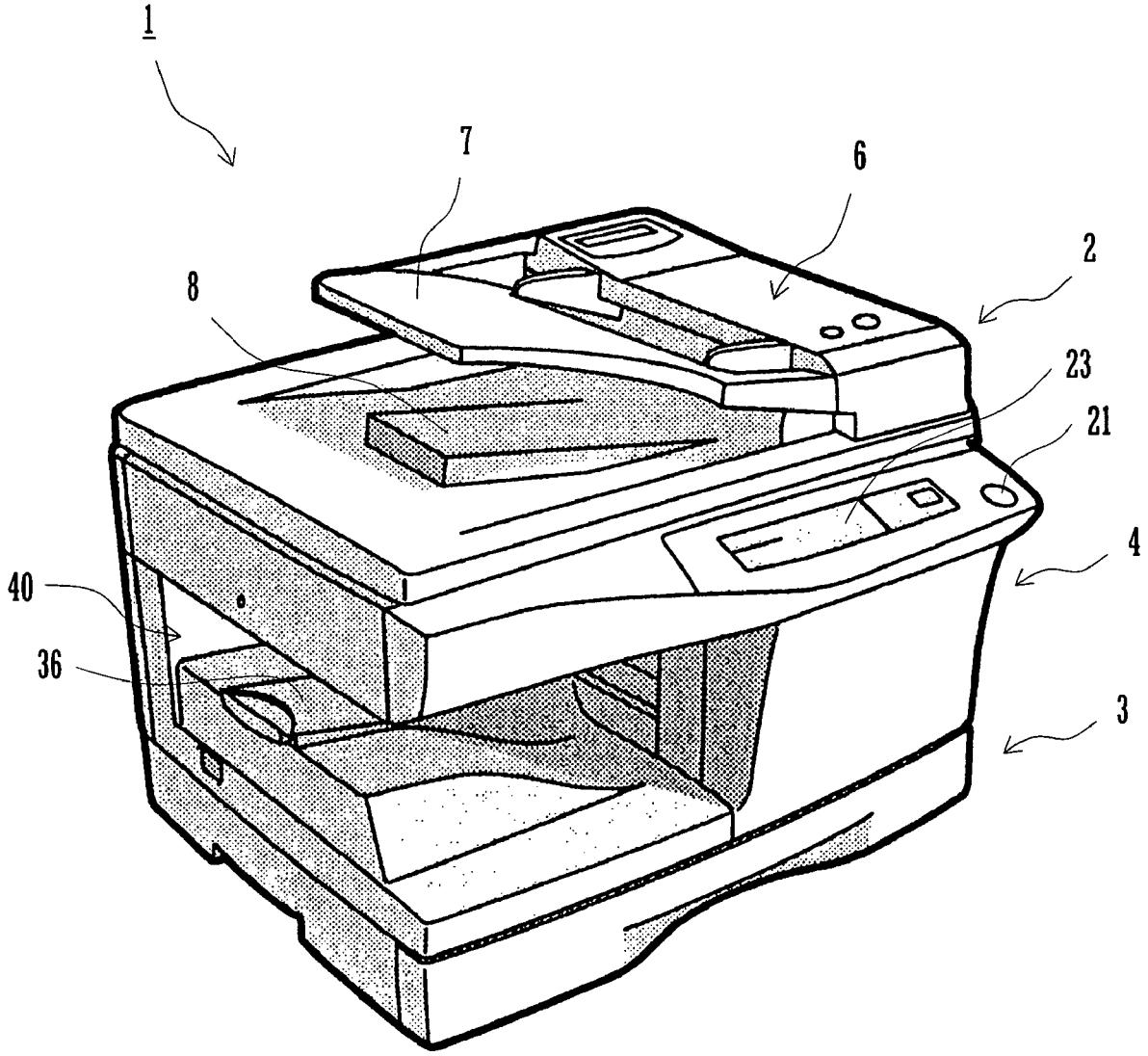
FIG. 1 is a perspective view of an image forming apparatus according to a preferred embodiment of the invention.

FIG. 1 is a perspective view of an image forming apparatus 1 according to an embodiment of the invention. As shown in FIG. 1, the image forming apparatus 1 includes an original scanning section 2, a sheet feeding section 3, an image forming section 4 and a sheet receiving section 40. The original scanning section 2 is disposed at an upper part of the image forming apparatus 1 while the sheet feeding section 3 is disposed at a bottom part of the image forming apparatus 1. The image forming section 4 is disposed between the original scanning section 2 and the sheet feeding section 3, so as to be sandwiched therebetween. The image forming section 4 is structured to have a small cross-sectional area when cut by a horizontal plane as compared to the original scanning section 2 and the sheet feeding section 3. Thus, there is formed a sheet receiving space surrounded by the original scanning section 2, the sheet feeding section 3 and the image forming section 4, and sheets ejected from the image forming section 4 are delivered into the sheet receiving space. The sheet receiving section 40 is disposed in this sheet receiving space.

There are provided an operating block 23 and a start key 21 at the upper part of the image forming apparatus 1, the operating block 23 including a touch panel for indicating information concerning operational states of the image forming apparatus 1 and accepting various user inputs.

Figure 2:
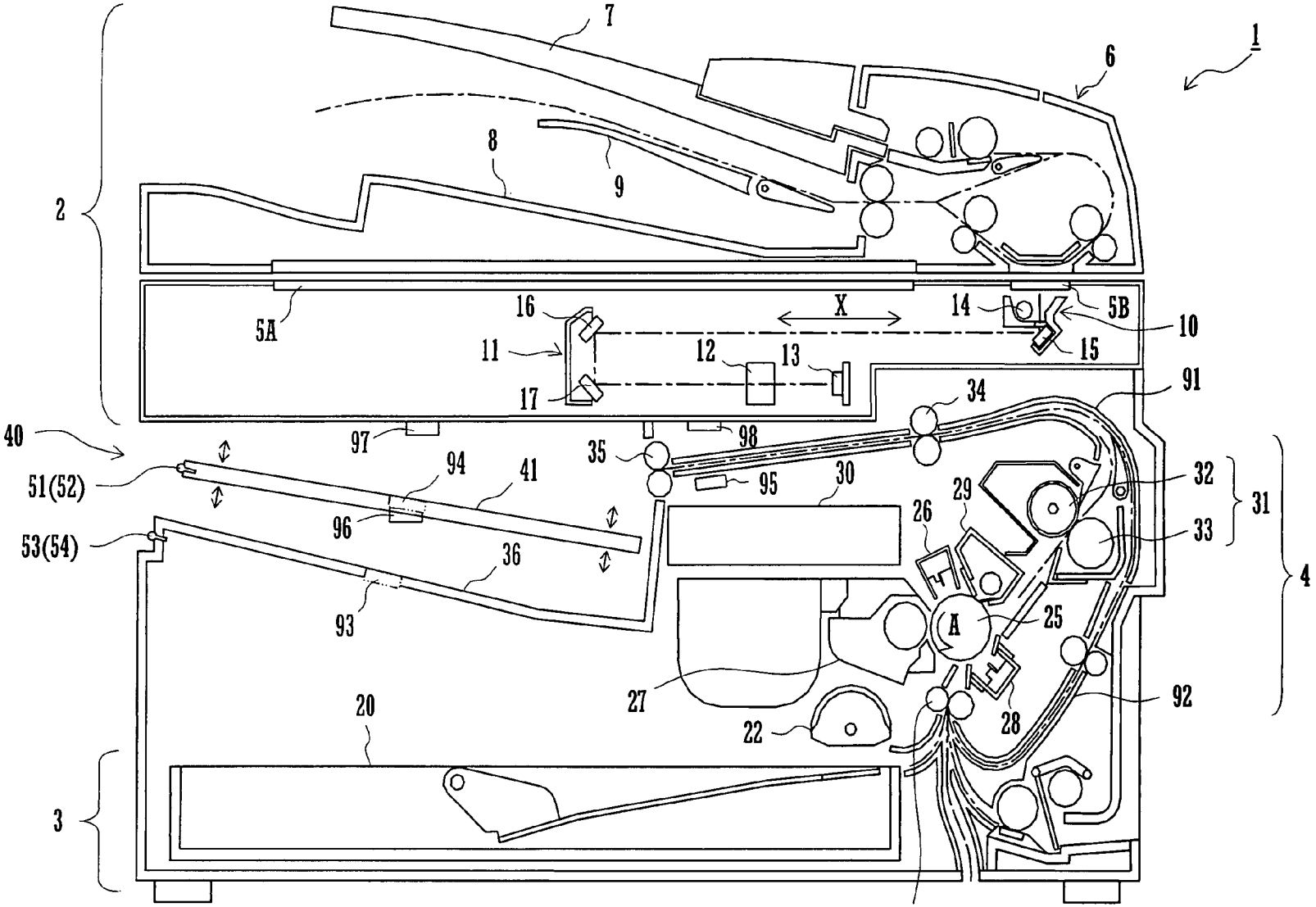
FIG. 2 is a frontal cross section of the image forming apparatus of the embodiment showing the internal structure thereof.

FIG. 2 is a frontal cross section of the image forming apparatus 1 of the embodiment showing the internal structure thereof. As shown in FIG. 2, the original scanning section 2 includes platens 5A, 5B made of transparent glass plates and an automatic document feeder 6 disposed above the platens 5A, 5B. The automatic document feeder 6 is associated with a document tray 7 on which sheets of an original document to be read, or scanned, are placed. When the sheets of the document to be scanned are single-sided originals, the automatic document feeder 6 feeds the individual originals loaded on the document tray 7 in such a way that each successive original is transported over the platen 5B and ejected onto a document receiving tray 8. When the sheets of the document to be scanned are double-sided originals, on the other hand, the automatic document feeder 6 feeds the individual originals loaded on the document tray 7 in such a way that each successive original is transported over the platen 5B, routed to an intermediate tray 9 and, with a leading edge and a trailing edge reversed, transported again over the platen 5B and ejected onto the document receiving tray 8.

The original scanning section 2 further includes a first scanning assembly 10, a second scanning assembly 11, a focusing lens 12 and a charge-coupled device (CCD) sensor 13 which are disposed beneath the platens 5A, 5B. The first scanning assembly 10 includes an exposure lamp 14 and a first reflecting mirror 15 while the second scanning assembly 11 includes a second reflecting mirror 16 and a third reflecting mirror 17. The exposure lamp 14 projects light onto an original placed on the platen 5A or onto an original being transported over the platen 5B. The first reflecting mirror 15, the second reflecting mirror 16 and the third reflecting mirror 17 work together to guide light reflected by the original to the CCD sensor 13. The focusing lens 12 focuses the light reflected by the original and guided by the mirrors 15, 16, 17 onto the CCD sensor 13. The CCD sensor 13 produces image data from the focused light through a photoelectric conversion process.

When scanning an original, the first scanning assembly 10 moves at a speed V in a sub-scanning direction parallel to the platens 5A, 5B as shown by a double arrow X in FIG. 2. While the first scanning assembly 10 moves in this way, the second scanning assembly 11 moves in the sub-scanning direction at a speed V/2.

The sheet feeding section 3 includes a sheet cassette 20 for accommodating sheets of printing paper on which images are to be formed. The sheet cassette 20 is made removable from the image forming apparatus 1. Here, the printing paper is just one example of printing media. Films for an overhead projector (OHP) and other printable sheets can also be used as printing media in the image forming apparatus 1 of the present embodiment.

The image forming section 4 includes a sheet transport path 91, a sheet reversing path 92, a photosensitive drum 25, a charging unit 26, a laser scanning unit (LSU) 30, a developing unit 27, an image transfer unit 28, a cleaning unit 29, a pair of registration rollers 24 and a fuser unit 31.

The sheet transport path 91 is routed between the sheet cassette 20 and ejecting rollers 35 for transporting each sheet, while the sheet reversing path 92 connected to the sheet transport path 91 is used during execution of a double-sided image forming job. The photosensitive drum 25 is disposed such that a cylindrical outer surface thereof lies in the sheet transport path 91. The photosensitive drum 25 rotates counterclockwise as shown by an arrow A in FIG. 2. The charging unit 26 charges the cylindrical outer surface of the photosensitive drum 25 to a specific potential level. The LSU 30 forms an electrostatic latent image of an original image on the cylindrical outer surface of the photosensitive drum 25, which has been charged to the specific potential level, by projecting laser light based on image data. The developing unit 27 produces a toner image by visualizing the electrostatic latent image formed on the cylindrical outer surface of the photosensitive drum 25. The image transfer unit 28 transfers the toner image thus formed on the cylindrical outer surface of the photosensitive drum 25 onto a sheet. The cleaning unit 29 collects residual toner powder left on the cylindrical outer surface of the photosensitive drum 25. The registration rollers 24 located at a position upstream of the photosensitive drum 25 along the sheet transport path 91 temporarily hold and advance each successive sheet so that each sheet passes between the photosensitive drum 25 and the image transfer unit 28 with proper timing. The fuser unit 31 located at a position downstream of the photosensitive drum 25 along the sheet transport path 91 includes a heat roller 32 and a pressure roller 33. The sheet carrying the transferred toner image is passed between the heat roller 32 and the pressure roller 33 of the fuser unit 31, whereby the toner image loosely adhering to the sheet is fused and firmly fixed to the sheet.

Provided downstream of the fuser unit 31 along the sheet transport path 91 are transport rollers 34 and the aforementioned ejecting rollers 35. The sheet receiving section 40 is located at a position where individual sheets are ejected by the ejecting rollers 35 to the exterior of the image forming apparatus 1.

The sheet receiving section 40 is provided with a stationary sheet receiving tray 36 and a movable sheet receiving tray 41. The movable sheet receiving tray 41 is made movable between an upper position and a lower position. Sheets are ejected onto the stationary sheet receiving tray 36 when the movable sheet receiving tray 41 is located at the upper position, whereas sheets are ejected onto the movable sheet receiving tray 41 when the movable sheet receiving tray 41 is located at the lower position.

A light source 93 for emitting a light beam is fitted in the stationary sheet receiving tray 36 while a photodetector 96 which detects the light beam emitted by the light source 93 is fitted on a bottom surface of the movable sheet receiving tray 41. The light source 93 and the photodetector 96 work together to detect whether one or more sheets are present on the stationary sheet receiving tray 36. Also, a light source 94 for emitting a light beam is fitted in the movable sheet receiving tray 41 while a photodetector 97 which detects the light beam emitted by the light source 94 is mounted at the top of the sheet receiving section 40 (or on a bottom surface of the original scanning section 2) at a position just above the light source 94. The light source 94 and the photodetector 97 work together to detect whether one or more sheets are present on the movable sheet receiving tray 41. In the present embodiment, the light sources 93, 94 and the photodetectors 96, 97 together constitute a detection sensor of the invention for detecting the ejected sheets. Additionally, a light source 95 for emitting a light beam is fitted along the sheet transport path 91 upstream of the ejecting rollers 35 in the proximity thereof while a photodetector 98 which detects the light beam emitted by the light source 95 is mounted on the bottom surface of the original scanning section 2. The light source 95 and the photodetector 98 work together to detect each sheet being transported through the sheet transport path 91 toward the ejecting rollers 35.

Figure 3:
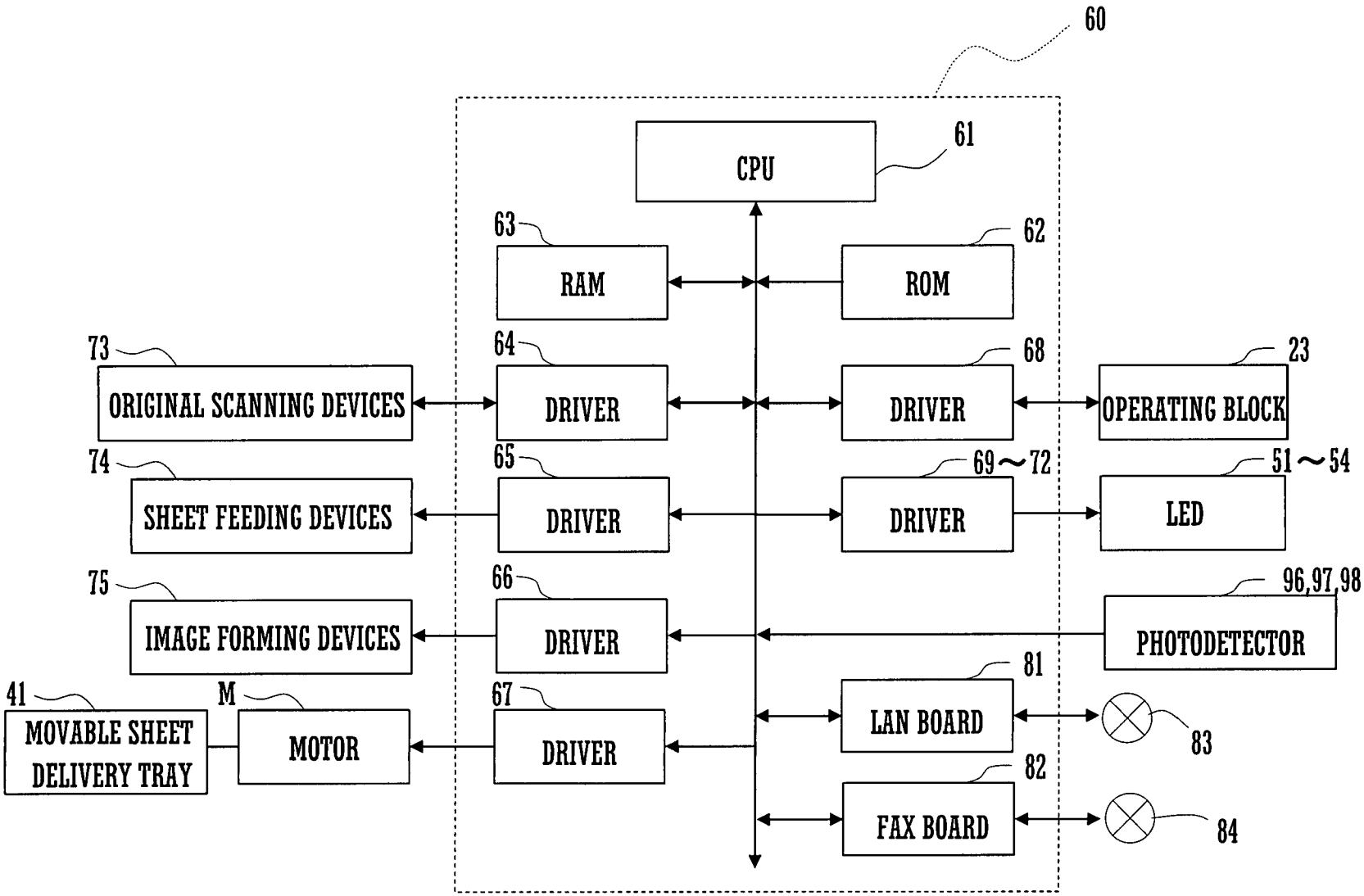
FIG. 3 is a block diagram generally showing the configuration of the image forming apparatus of the embodiment.

As shown in FIG. 3, the image forming apparatus 1 has a control block 60 which includes a read-only memory (ROM) 62, a random access memory (RAM) 63, a central processing unit (CPU) 61, a local area network (LAN) board 81, a facsimile (FAX) board 82, drivers 64 to 72 and the aforementioned photodetectors 96, 97, 98. The ROM 62 stores a program necessary for correctly operating the image forming apparatus 1. The RAM 63 is a volatile memory for temporarily storing image data produced from each scanned original. The CPU 61 performs overall control of the operation of the image forming apparatus 1 according to the program stored in the ROM 62. The LAN board 81 performs a function which enables the image forming apparatus 1 to communicate with an external device, such as a personal computer, connected to the image forming apparatus 1 via a network 83. The FAX board 82 performs a function which enables the image forming apparatus 1 to communicate with an external device, such as a facsimile receiver, connected to the image forming apparatus 1 via a public communications line 84.

The driver 64 drives according to a signal fed from the CPU 61 various original scanning devices 73 which include the first scanning assembly 10, the second scanning assembly 11 and the CCD sensor 13. The driver 65 drives according to a signal fed from the CPU 61 sheet feeding devices 74 which include a pickup roller 22 for successively feeding sheets out of the sheet cassette 20. The driver 66 drives according to a signal fed from the CPU 61 various image forming devices 75 which include the photosensitive drum 25, the charging unit 26, the developing unit 27 and the image transfer unit 28. The driver 67 actuates a motor M according to a signal fed from the CPU 61 for causing the movable sheet receiving tray 41 to ascend or descend. The driver 68 controls various indications given on the operating block 23.

Figure 4:
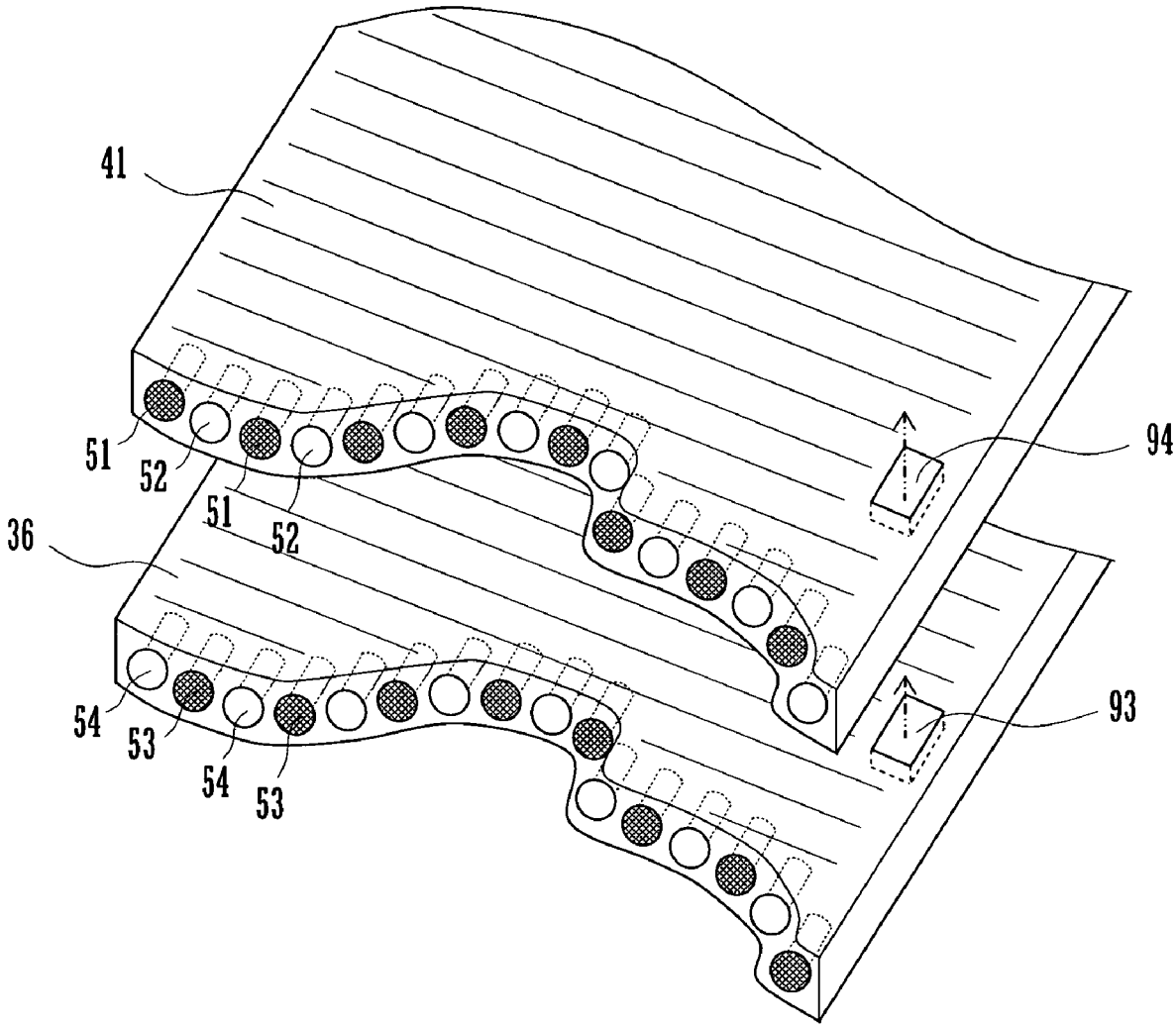
FIG. 4 is a fragmentary perspective view of an indicator of the image forming apparatus of the embodiment.

The drivers 69 to 72 control lighting of groups of light-emitting diodes (LEDs) 51 to 54, in which the LED group 51 is a group of red LEDs, the LED group 52 is a group of green LEDs, the LED group 53 is a group of red LEDs, and the LED group 54 is a group of green LEDs. The red LED group 53 and the green LED group 54 are arranged on a side surface of the stationary sheet receiving tray 36, while the red LED group 51 and the green LED group 52 are arranged on a side surface of the movable sheet receiving tray 41 as illustrated in FIG. 4. These LED groups 51 to 54 which project light chiefly in a lateral direction of the image forming apparatus 1 together constitute an indicator of the invention. The driver 69 causes the individual LEDs of the LED group 51 to light, become extinguished or blink. Likewise, the driver 70 causes the individual LEDs of the LED group 52 to light, become extinguished or blink, the driver 71 causes the individual LEDs of the LED group 53 to light, become extinguished or blink, and the driver 72 causes the individual LEDs of the LED group 54 to light, become extinguished or blink.

The image forming apparatus 1 offers a choice of three operation modes, that is, copier mode, printer mode and facsimile mode. In the copier mode, the image forming section 4 carries out an image forming job based on image data generated by the original scanning section 2. The image data generated by the original scanning section 2 is subjected to image processing which is performed in a specific sequence under the control of the control block 60. In the printer mode, the image forming section 4 carries out an image forming job based on image data input through the LAN board 81. In the facsimile mode, the image forming section 4 carries out an image forming job based on image data input through the FAX board 82.

Referring now to FIG. 2, operation of the image forming apparatus 1 is described. When the start key 21 is pressed or image data is input through the LAN board 81 or the FAX board 82, the sheet feeding section 3 begins to feed a sheet. The sheet fed into the sheet transport path 91 is held in a standby condition at the registration rollers 24 with a leading edge of the sheet nipped between the two facing registration rollers 24. The registration rollers 24 advances the sheet downstream along the sheet transport path 91 toward a position between the photosensitive drum 25 and the image transfer unit 28 with proper timing such that a leading edge of an image forming area of the sheet correctly aligns with a leading edge of a toner image formed on the cylindrical outer surface of the photosensitive drum 25. The sheet onto which the toner image has been transferred is fed further downstream along the sheet transport path 91 and reaches the fuser unit 31, which fixes the toner image to the sheet. The sheet which has passed through the fuser unit 31 is transferred further downstream along the sheet transport path 91 by the transport rollers 34 and ejected to the sheet receiving section 40 by the ejecting rollers 35.

When images are to be formed on both sides of a sheet (double-sided image forming job), the sheet carrying a toner image on one side which has passed through the fuser unit 31 is transferred into the sheet reversing path 92 and guided back to the registration rollers 24 with the two sides of the sheet reversed. Then, the sheet is passed again between the photosensitive drum 25 and the image transfer unit 28 and through the fuser unit 31, whereby a toner image is formed on the opposite side of the sheet. The sheet carrying the images on both sides is eventually ejected to the sheet receiving section 40.

Whether the stationary sheet receiving tray 36 or the movable sheet receiving tray 41 is used is determined according to which operation mode, that is, the copier mode, the printer mode or the facsimile mode, is currently selected. In this embodiment, the selection of the stationary sheet receiving tray 36 or the movable sheet receiving tray 41 is determined in consideration of which one of these sheet receiving trays 36, 41 is empty before execution of each job. In practice, an empty one of these sheet receiving trays 36, 41 is used. If one or more printouts (or sheets carrying images) delivered by a previously finished job are present on the stationary sheet receiving tray 36, for example, the image forming apparatus 1 delivers printouts finished in a succeeding job to the movable sheet receiving tray 41 regardless of which operation mode is currently selected. More specifically, the CPU 61 judges whether the stationary sheet receiving tray 36 or the movable sheet receiving tray 41 is empty based on sensing results fed from the photodetectors 96 and 97 and causes the image forming apparatus 1 to deliver sheets carrying printed images to the sheet receiving tray 36 or 41 whichever empty. With this arrangement, the image forming apparatus 1 is less likely to deliver sheets carrying images finished in multiple jobs onto the same sheet receiving tray 36, 41, thereby ensuring that users can easily collect printouts delivered as a result of by their own image forming commands.

Additionally, the image forming apparatus 1 of the embodiment employs an arrangement which enables the users to easily recognize whether sheets ejected onto each of the stationary sheet receiving tray 36 and the movable sheet receiving tray 41 are printouts delivered as a result of a job in the copier mode, the printer mode or the facsimile mode. Specifically, if printouts delivered as a result of a job in the copier mode are present on one or both of the sheet receiving trays 36, 41, the image forming apparatus 1 notifies the users by means of the red LEDs of the LED groups 51 and/or 53. If printouts delivered as a result of a job in the facsimile mode are present on one or both of the sheet receiving trays 36, 41, the image forming apparatus 1 notifies the users by means of the green LEDs of the LED groups 52 and/or 54. If printouts delivered as a result of a job in the printer mode are present on one or both of the sheet receiving trays 36, 41, the image forming apparatus 1 notifies the users by a combination of the red LEDs of the LED groups 51 and/or 53 and the green LEDs of the LED groups 52 and/or 54. More specifically, if finished printouts have been delivered onto the stationary sheet receiving tray 36 as a result of a job in the copier mode, for example, the CPU 61 causes the red LEDs of only the LED group 53 on the side surface of the stationary sheet receiving tray 36 to light through the driver 71. Similarly, if finished printouts have been delivered onto the movable sheet receiving tray 41 as a result of a job in the facsimile mode, the CPU 61 causes the green LEDs of only the LED group 52 on the side surface of the movable sheet receiving tray 41 to light through the driver 70. Also, if finished printouts have been delivered onto the movable sheet receiving tray 41 as a result of a job in the printer mode, the CPU 61 causes both the red LEDs of the LED group 51 and the green LEDs of the LED group 52 to light through the drivers 69, 70. Since light emitted by the red and green LED groups 51 to 54 is visible from a distance, even those users who are situated away from the image forming apparatus 1 can recognize whether the printouts have been delivered to the sheet receiving section 40 with the aid of lighting conditions of the LED groups 51 to 54.

The photodetector 98 works together with the light source 95 to detect jams occurring in the sheet transport path 91 close to the receiving rollers 35. When the photodetector 98 detects a jam, the photodetector 98 outputs a sensing result to the CPU 61. Should this situation occurs, the CPU 61 interrupts operation of the image forming section 4 and gives a warning on the operating block 23, for instance, to annunciate the occurrence of a jam according to the sensing result received.

In the image forming apparatus 1 of the present embodiment, the sheet receiving section 40 is disposed as if surrounded by the original scanning section 2, the image forming section 4 and the sheet feeding section 3 as thus far discussed. According to this structure of the embodiment, the image forming apparatus 1 can be placed in a small installation space.

Although the inside of the sheet receiving section 40 is more or less difficult to see from a distance, a user can recognize completion of each image forming job by checking out the lighting conditions of the LED groups 51 to 54. Moreover, the user can recognize from the lighting conditions of the LED groups 51 to 54 not only whether printouts have been delivered to the stationary sheet receiving tray 36 or the movable sheet receiving tray 41 but whether the printouts have been delivered as a result of a job in the copier mode, the printer mode or the facsimile mode.

It will be appreciated from the foregoing discussion that the user can easily recognize that printouts have been delivered to the stationary sheet receiving tray 36 or the movable sheet receiving tray 41 as a result of an own image forming command even when the user is situated away from the image forming apparatus 1. Therefore, it is likely that sheets delivered to the stationary sheet receiving tray 36 or the movable sheet receiving tray 41 are collected earlier by individual users.

While the LED groups 51 to 54 are arranged on the side surfaces of the stationary sheet receiving tray 36 and the movable sheet receiving tray 41 in the foregoing embodiment, the invention is not limited to this arrangement of the LED groups 51 to 54. For example, the LED groups 51 to 54 may be disposed on front sides of the stationary sheet receiving tray 36 and the movable sheet receiving tray 41 so that the lighting conditions of the LED groups 51 to 54 can be easily recognized from the front of the image forming apparatus 1. Alternatively, the LED groups 51 to 54 may be disposed on a front or side surface of a housing of the image forming apparatus 1 so that the lighting conditions of the LED groups 51 to 54 can be easily recognized from the respective directions.

Furthermore, although the image forming apparatus 1 of the embodiment employs the red LED groups 51, 53 and the green LED groups 52, 54, the LED groups 51 to 54 are not limited to these two colors. For example, the LED groups 51 to 54 may be combinations of red and blue LED groups or green and blue LED groups, or combinations of three or more color LED groups. While the image forming apparatus 1 of the embodiment employs as the indicator the LED groups 51 to 54 for saving power consumption, other types of light-emitting devices, such as lamps, may be used to constitute an indicator.

Furthermore, the CPU 61 may control the drivers 69 to 72 such that pertinent LEDs of the LED groups 51 to 54 light when a specific period of time (e.g., 10 seconds) has elapsed after the photodetector 96 or the photodetector 97 has detected that printouts have been delivered to the stationary sheet receiving tray 36 or the movable sheet receiving tray 41, respectively. This is because a user currently using the image forming apparatus 1 in the copier mode in front of the image forming apparatus 1 can easily see conditions of the sheet receiving section 40 with his or her own eyes. If the drivers 69 to 72 are controlled in this fashion, the LED groups 51 to 54 would not unnecessarily light, and this arrangement serves to reduce power consumption and prolong useful life of the LED groups 51 to 54.

While the photodetectors 96, 97 detect that sheets carrying printed images have been delivered to the sheet receiving section 40 in the foregoing embodiment, the image forming apparatus 1 may be modified such that the photodetector 98 which works together with the light source 95 detects that the sheets have been delivered to the sheet receiving section 40 when each sheet passing between the light source 95 and the photodetector 98 is detected. In this case, whether the sheets have been delivered onto the stationary sheet receiving tray 36 or the movable sheet receiving tray 41 is determined based on information on the position of the movable sheet receiving tray 41, so that the light sources 93, 94 and the photodetectors 96, 97 are not necessary. In this modified form of the embodiment, the light source 95 and the photodetector 98 together constitute a detection sensor of the invention for detecting the ejected sheets.

Moreover, the image forming apparatus 1 of the foregoing embodiment may be so modified as to notify individual users of information on operating conditions of the original scanning section 2 and the image forming section 4 by using the LED groups 51 to 54. For example, the image forming apparatus 1 may be modified such that the red LED groups 51, 53 blink while the original scanning section 2 is in operation and the green LED groups 52, 54 blink while the image forming section 4 is in operation. Alternatively, the image forming apparatus 1 may be modified such that the red LED groups 51, 53 blink to annunciate the occurrence of a jam of an original in the original scanning section 2 and the green LED groups 52, 54 blink to annunciate the occurrence of a jam of a printing sheet in the image forming section 4. The image forming apparatus 1 thus modified enables the users to recognize the operating conditions of the original scanning section 2 and the image forming section 4 from a distance.

While the invention has thus far been described with reference to the preferred embodiment thereof, the aforementioned arrangement of the embodiment should be construed as being simply illustrative and not limiting the invention. The scope of the invention is shown solely by the appended claims, and not by the foregoing embodiment. It is to be understood that the invention is intended to cover the appended claims as well as all possible modifications of the embodiment and equivalents thereof which may occur to those skilled in the art within the spirit and scope of the invention.

What is claimed is:

1. An image forming apparatus, comprising:

a document scanning section for generating image data from image information obtained by scanning a document image;

a sheet feeding section located below the document scanning section for accommodating sheets of a printing medium, the sheet feeding section arranged at a predetermined distance from the document scanning section;

an image forming section located between the document scanning section and the sheet feeding section for forming an image on the printing medium based on the image data fed from the document scanning section or on externally supplied image data, the image forming section having a smaller cross-sectional area when cut by a horizontal plane than either of the document scanning section and the sheet feeding section such that a sheet receiving space into which each sheet of the printing medium is ejected is left between the document scanning section and the sheet feeding section;

a sheet receiving section located in the sheet receiving space for receiving the sheets of the printing medium ejected from the image forming section, the sheet receiving section having at least one sheet receiving tray;

a detection sensor for detecting the sheets of the printing medium ejected to the sheet receiving section;

an indicator, disposed at a side surface of the at - least one sheet receiving tray, for emitting light based on sensing results obtained by the detection sensor;

a LAN board for performing a function which enables the image forming apparatus to communicate with an external device connected via a network; and a FAX board for performing a function which enables the image forming apparatus to communicate with an external device connected via a public communications line;

wherein the image forming apparatus offers a choice of at least three operation modes including copier mode in which the image forming section forms an image on the printing medium based on the image data generated by the document scanning section, printer mode in which the image forming section forms an image on the printing medium based on the image data fed through the LAN board and facsimile mode in which the image forming section forms an image on the printing medium based on the image data fed through the FAX board, the indicator emits the light in different ways depending on which operation mode is currently selected, the sheet receiving section includes a plurality of sheet receiving trays, the detection sensor detects onto which sheet receiving tray any sheet of the printing medium has been ejected, the indicator is disposed at a side surface of each of the sheet receiving trays and emits the light depending on the sensing results obtained by the detection sensor in such a manner that only indicator disposed on the sheet receiving tray onto which any sheet of the printing medium has been ejected emits the light, the indicator includes a plurality of LED groups which emit the light in different colors, the indicator begins to emit the light when a specific period of time has elapsed after the printing medium has been ejected to the sheet receiving section in the copier mode and the specific period of time elapsed in copier mode is greater than a period of time elapsed in printing mode or in facsimile mode.

2. The image forming apparatus according to claim 1, wherein the indicator emits the light in different ways depending on operating conditions of the document scanning section and the image forming section.

3. The image forming apparatus according to claim 1, wherein the detection sensor is provided inside the image forming section.

4. The image forming apparatus according to claim 1, wherein the sheet receiving tray is configured to be at an angle in such a manner that the sheet receiving tray is higher at outer end than the other, and wherein the indicator is adapted to project light obliquely and upwardly.

5. The image forming apparatus according to claim 1, wherein the indicator emits the light in a fourth way to indicate a jam has occurred.

6. The image forming apparatus according to claim 1, wherein the specific period of time elapsed in copier mode is greater than periods of time elapsed in printing mode and in facsimile mode.

7. the image forming apparatus according to claim 1, wherein the period of time elapsed in printing mode or in facsimile mode is time between the ejection of the printing medium to the sheet receiving section and emission of light from the indicator in the respective modes.

8. An image forming apparatus, comprising:

a document scanning section for generating image data from image information obtained by scanning a document image;

a sheet feeding section located below the document scanning section for accommodating sheets of a printing medium, the sheet feeding section arranged at a predetermined distance from the document scanning section;

an image forming section located between the document scanning section and the sheet feeding section for forming an image on the printing medium based on the image data fed from the document scanning section or on externally supplied image data, the image forming section having a smaller cross-sectional area when cut by a horizontal plane than either of the document scanning section and the sheet feeding section such that a sheet receiving space into which each sheet of the printing medium is ejected is left between the document scanning section and the sheet feeding section;

a sheet receiving section located in the sheet receiving space for receiving the sheets of the printing medium ejected from the image forming section, the sheet receiving section having at least one sheet receiving tray;

a detection sensor for detecting the sheets of the printing medium ejected to the sheet receiving section;

an indicator, disposed at a side surface of the at least one sheet receiving tray, for emitting light based on sensing results obtained by the detection sensor;

a LAN board for performing a function which enables the image forming apparatus to communicate with an external device connected via a network; and a FAX board for performing a function which enables the image forming apparatus to communicate with an external device connected via a public communications line;

wherein the image forming apparatus offers a choice of at least three operation modes including copier mode in which the image forming section forms an image on the printing medium based on the image data generated by the document scanning section, printer mode in which the image forming section forms an image on the printing medium based on the image data fed through the LAN board and facsimile mode in which the image forming section forms an image on the printing medium based on the image data fed through the FAX board, the indicator emits the light in a first way to indicate that the copier mode is currently selected, emits light in a second way to indicate that the printer mode is currently selected and emits light in a third way to indicate that the facsimile mode is currently selected, the sheet receiving section includes a plurality of sheet receiving trays, the detection sensor detects onto which sheet receiving tray any sheet of the printing medium has been ejected, the indicator is disposed at a side surface of each of the sheet receiving trays and emits the light depending on the sensing results obtained by the detection sensor in such a manner that only indicator disposed on the sheet receiving tray onto which any sheet of the printing medium has been ejected emits the light, the indicator includes a plurality of LED groups which emit the light in different colors, and uses a different set of the LED groups for each way of emitting light, the indicator begins to emit the light when a specific period of time has elapsed after the printing medium has been ejected to the sheet receiving section in the copier mode, and the specific period of time elapsed in copier mode is greater than a period of time elapsed in printing mode or in facsimile mode.

9. The image forming apparatus according to claim 8, wherein the detection sensor is located on each of the at least one sheet receiving trays and detects the sheets of the printing medium ejected to the corresponding sheet receiving tray of the sheet receiving section, causing output of a next printing job to be changed to another sheet receiving tray from a current sheet receiving tray based on a detection result of the detection sensor.

10. The image forming apparatus according to claim 8, wherein the specific period of time elapsed in copier mode is greater than periods of time elapsed in printing mode and in facsimile mode.

11. the image forming apparatus according to claim 8, wherein the period of time elapsed in printing mode or in facsimile mode is time between the ejection of the printing medium to the sheet receiving section and emission of light from the indicator in the respective modes.

* * * * *